United States Patent [19]

Hubbard

[11] Patent Number: 4,852,479

[45] Date of Patent: Aug. 1, 1989

[54] POSTAGE METER HAVING A WORM GEAR DRIVE

[75] Inventor: David W. Hubbard, Stamford, Conn.

[73] Assignee: Pitney Bowes Inc., Stamfod, Conn.

[21] Appl. No.: 129,638

[22] Filed: Dec. 7, 1987

[51] Int. Cl.[4] ..... B41J 1/22

[52] U.S. Cl. ..... 101/91; 101/110; 74/89.15; 74/59; 74/425.5

[58] Field of Search ..... 400/161.3; 101/90, 91, 101/92, 110, 111; 74/59, 89.15, 425.5

[56] References Cited

U.S. PATENT DOCUMENTS

| | | | |
|---|---|---|---|
| 2,773,966 | 12/1956 | Masterpole | 74/59 |
| 3,122,026 | 2/1964 | Pearson et al. | 74/59 |
| 3,589,281 | 6/1971 | Woodhead | 101/91 |
| 3,890,491 | 6/1975 | Malavazos et al. | 101/91 |
| 4,095,686 | 6/1978 | Okabe | 400/161.3 |
| 4,121,473 | 10/1978 | Schubert et al. | 74/89.15 |
| 4,221,135 | 9/1980 | Schubert | 74/29 |
| 4,398,458 | 8/1983 | Denzin et al. | 101/110 |
| 4,603,627 | 8/1986 | Pollak, Jr. et al. | 101/91 |
| 4,672,858 | 6/1987 | Langowski | 74/89.15 |
| 4,700,251 | 10/1987 | Fuke et al. | 74/89.15 |
| 4,723,486 | 2/1988 | Le Meur et al. | 101/91 |
| 4,735,138 | 4/1988 | Gawler et al. | 101/91 |
| 4,759,283 | 7/1988 | Gilham et al. | 101/91 |

FOREIGN PATENT DOCUMENTS

| | | | |
|---|---|---|---|
| 455533 | 3/1949 | Canada | 74/59 |
| 2059878 | 4/1981 | United Kingdom | 101/91 |
| 2177656 | 1/1987 | United Kingdom | 101/91 |

*Primary Examiner*—William Pieprz

*Attorney, Agent, or Firm*—Peter Vrahotes; Melvin J. Scolnick; David E. Pitchenik

[57] ABSTRACT

This invention relates to a postage meter having a plurality of worm gears for adjusting the rotational position of postage print wheels. Each worm gear selectively moves a rack which is an engagement with a postage print wheel so as to provide rotational movement to the print wheel. Sensors are provided so that the rotational position of each worm gear can be determined thereby indicating the position of the print wheels.

14 Claims, 5 Drawing Sheets

POSTAGE METER HAVING A WORM GEAR DRIVE

BACKGROUND OF THE INVENTION

Postage meters are devices for dispensing value in the form of postage printed upon a mail piece such as an envelope. The postage meter has the ability to record the amount of postage printed by the meter in a secure manner. The term postage meter also includes meters such as parcel post meters and tax stamp meters. Contemporary postage meters have print wheels with print elements in the form of font characters representing values of zero through nine located about the perimeter thereof that are used to print the postage. With four print wheels, the print wheels can be independently positioned to allow a user to set any amount of postage between $00.00 (for test purposes) to $99.99. As a mail piece is placed into position, the print wheels are inked and then are driven into contact with the mail piece to imprint postage thereon. Obviously, the print wheels must be selectively adjusted as required to assure the proper amount of postage is printed. For this purpose, each print wheel is rotatably supported within the postage meter and has a setting mechanism associated therewith such as a coaxial gear integral therewith or secured thereto. A device, such as a rack, engages the gear of the print wheel at one of its ends, and at its opposite end, the rack is engaged by another gear that is driven by either a motor or a lever in the case of manual setting. With such arrangements, there is a relatively large number of gears and levers located between the print wheels and the source of power.

U.S. Pat. No. 3,978,457 to Check et al, filed Dec. 23, 1974, describes an electronic postage meter in which the printing and value setting mechanism are electronically controlled. Each print wheel is set to position a different postage amount by an independently rotatable gear mechanism. The gear mechanisms are engaged by a master gear one at a time, a master gear being rotatably mounted within a laterally movable carriage. The carriage can be moved to cause the master gear to engage in turn with the gear mechanisms. The carriage is positioned by a pair of solenoids acting through a variable linkage and the master gear is driven by a stepper motor. The print drum is driven by a separate motor. An electronic control system is fully described for operating the value setting and printing mechanisms in correct sequence in accordance with values selected by inputting through a keyboard. It will also be noted that the meter may be detachably mounted on a base containing certain mechanical drives although the drives for the setting mechanism are contained in the meter itself.

U.S. Pat. No. 4,050,374 to Check, filed June 21, 1976, describes a setting mechanism for a postage meter similar to that employed in the meter of earlier U.S. Pat. No. 3,978,457 in which the solenoids for positioning the master gear carriage are replaced by a stepper motor. U.S. Pat. No. 4,050,374 also describes a mechanism for locking the print drum against rotation during value setting. Further aspects and alternatives to the setting mechanism of such postal meter systems are disclosed in U.S. Pat. Nos. 3,965,815 and 3,977,320 to Lupkis et al.

U.S. Pat. No. 4,287,825 to Eckert, Jr. et al, filed Oct. 30, 1979 discloses a setting mechanism like that in U.S. Pat. No. 4,050,374 referred to above with a modified locking mechanism for the print drum during value selection.

U.S. Pat. No. 4,367,676 to Clark, filed May 22, 1981, describes a different approach to value setting. Here a bank of value setting gears equal to the number of print wheels is drivingly connected to respective print wheels one at a time to set the print wheels. A pinion rotated by a stepper motor is shifted from setting gear to setting gear by a tracking mechanism driven by a separate motor which also rotates the print drum at the same time.

U.S. Pat. No. 4,140,055 to Lellemand filed June 6, 1977 discloses a print wheel value changing system using a planet wheel transmission device in which an eccentrically mounted pinion meshes with a ring gear within a postage printing drum which supports the postage printing wheel.

Also of interest in this area are U.S. Pat. Nos. 3,965,815 and 3,977,320 which relate to electromechanical setting mechanisms for rotary drum postage meters. Other patents of general interest include U.S. Pat. Nos. 3,876,870; 3,890,491; 3,892,355; 3,916,361 and 3,949,203 issued to Malavazos et al.

Although the prior postage meter value setting schemes worked well, there have been shortcomings in terms of efficiency, economy and noise. Because of the many parts of the drive train provided to adjust the radial location of the print wheels, there was a tolerance build up. As is known, when two gears engage one another, the teeth of the gears must be precisely located, otherwise a stripping of the gears could result. In postage meters this is even of greater necessity because the location of the print wheels must be precise in order to determine the amount of postage being printed. For this reason, great measures are taken to assure that the drive train is accurately driven. With the many parts of a drive train now in existence, one is faced with the problem of tolerance build up. More specifically, each part and its interaction with another part involves a certain tolerance. When there are large numbers of parts that are interconnected to one another, there is a build up of tolerances. As one proceeds from one end of the drive train to the other, each component contributes its particular tolerance to the overall building of tolerances. For this reason, it would be advantageous to reduce the number of parts in a postage meter print wheel drive train. Another problem is encountered when the gear teeth do not mesh accurately; noise results when the gears are actuated to drive the print wheels. In addition, because the motor that drives each rack does not start and stop instantly, there is a certain backlash upon termination of drive to the print wheels. This causes a slight, undesirable movement of the print wheel for which compensation must be made.

It obviously would be desirable to provide a drive train for a postage meter that has few parts, operates more quietly, and yet provides the security and accuracy required in a postage meter.

SUMMARY OF THE INVENTION

The present invention embodies various improvements to postage meters generally and particularly to the printing mechanisms therefor. A novel system is disclosed for the setting of the postage value amounts in postage meters and for driving and operating the meter. The system includes, inter alia, a novel approach to moving the racks which control the value selection for printing on the mailpiece by the postage meter, particularly a system of the type having axially displaceable setting racks.

It has been found that using a worm gear drive for selectively rotating the print wheels of a postage meter for the purpose of setting the postage amount results in an advantageous advancement over the art. This advantageous advancement is achieved because the drive train has fewer and less complicated parts. In addition, the noise level is reduced because the pitch of the worm gear can be adjusted so that the movement of the rack can be distributed over the drive period of the drive motor.

In the instant invention, each rack has a follower secured thereto that extends outwardly to be received within the helical thread of a worm gear that is connected to a drive motor. The rack also engages the gear of the print wheel so that as the rack is moved linearly, the print wheel will be rotated to a selected rotational position as is known in the art. As the worm gear is rotated, the follower will follow the profile of the threads of the helix in the worm gear thereby driving the rack linearly. The pitch of the worm gear is such that the movement of the rack is controlled so that movement of the rack varies throughout the entire drive of the drive motor. A drive motor is directly connected to the worm gear to provide rotational drive thereto, and extending from the motor is a timing disk that allows the determination of the rotational position of the worm gear. As fabricated, upon each 360° rotation of the worm gear, the print wheel will be rotated one increment or unit, for example, from "0" to "1". As a consequence, with rotation of the timing gear, it can be determined exactly where the print wheel is in terms of its rotational location.

BRIEF DESCRIPTION OF THE DRAWINGS

FIG. 9 is a block diagram showing a portion of the circuitry of the postage meter shown in FIG. 1.

DETAILED DESCRIPTION OF THE PREFERRED EMBODIMENT

Figure 1:
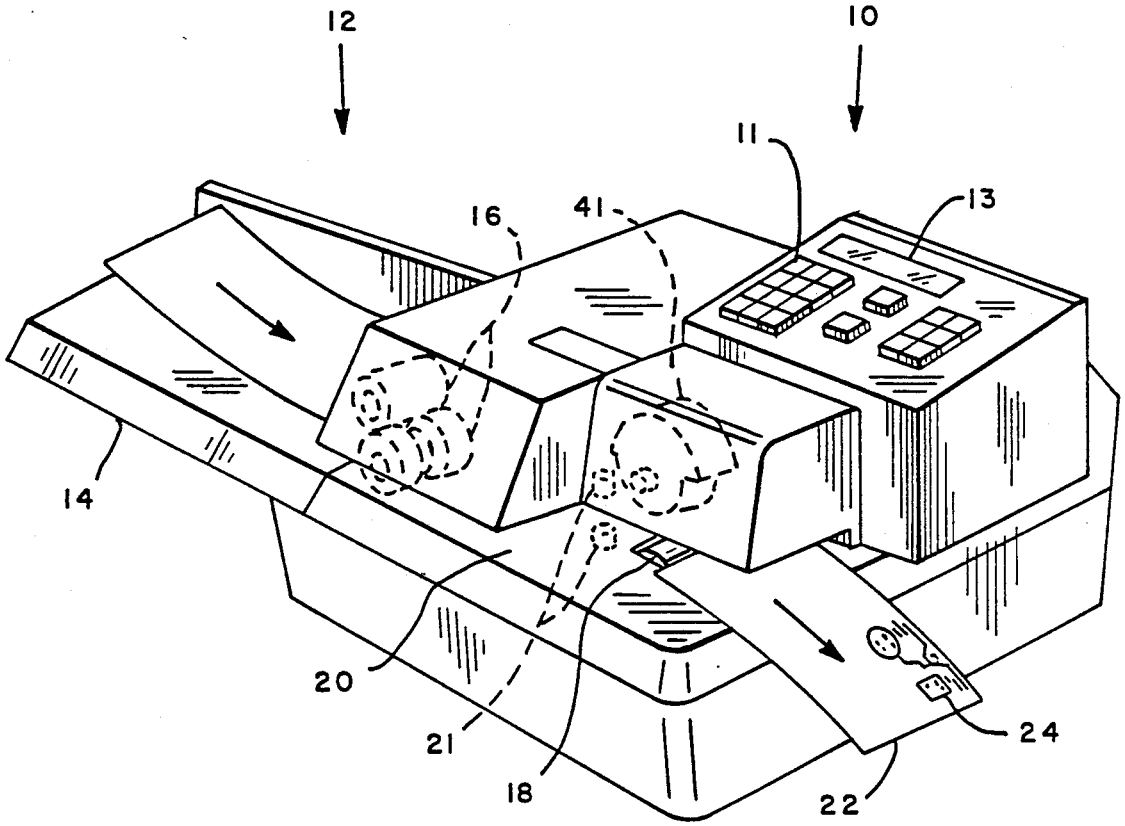
FIG. 1 shows a perspective view of the combination of a mailing machine and a postage meter in which the invention can be practiced.

Referring initially to FIG. 1, a postage meter is shown generally at 10, the postage meter having a keyboard 11 and a display 13. The postage meter 10 is shown as it is attached to a mailing machine 12 which mailing machine has an envelope feeder portion 14 with rollers 16. Another roller 18 is received within a platform 20 portion of the mailing machine 12, the rollers 16 and 18 being provided to convey mail pieces 22 across the mailing machine 10 for the purpose of having the meter 10 print postage indicia 24 upon the mail pieces. Located upstream from the roller 18 is a sensing device 21 that senses the leading edge of an envelope 22 that is transported by the rollers 16. This sensing device 21 may be a light-detector combination supported by the postage meter 10 and mailing machine 12. Although the invention will be described as it may be utilized in a postage meter of the rotary drum type, it will be appreciated that the principles of the instant invention will apply to other types of postage meters such as flatbed, reciprocating postage meters as well.

With reference now to FIGS. 2–5, the mailing machine 12 includes a housing 28 having an opening 30 therein. Supported within the mailing machine 12 is a motor 26 and a gear 28 is attached to the output shaft of the motor 26, which gear 28 extends through the opening 30. This combination of motor 26 and gear 28 provides drive to the postage meter 10 as will be explained hereinafter.

Figure 2:
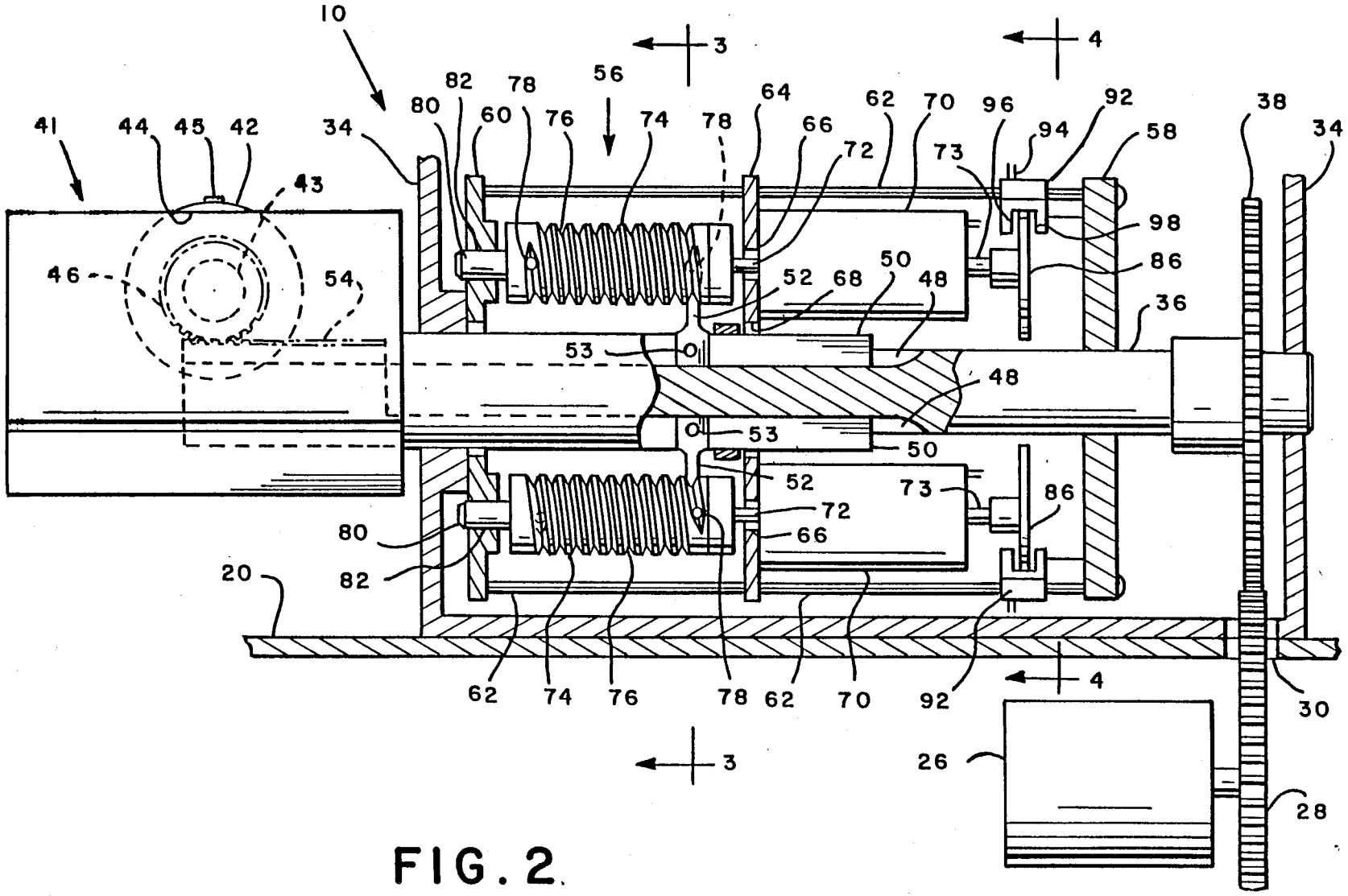
FIG. 2 shows a cross sectional view of the postage meter and a portion of the mailing machine.
Figure 3:
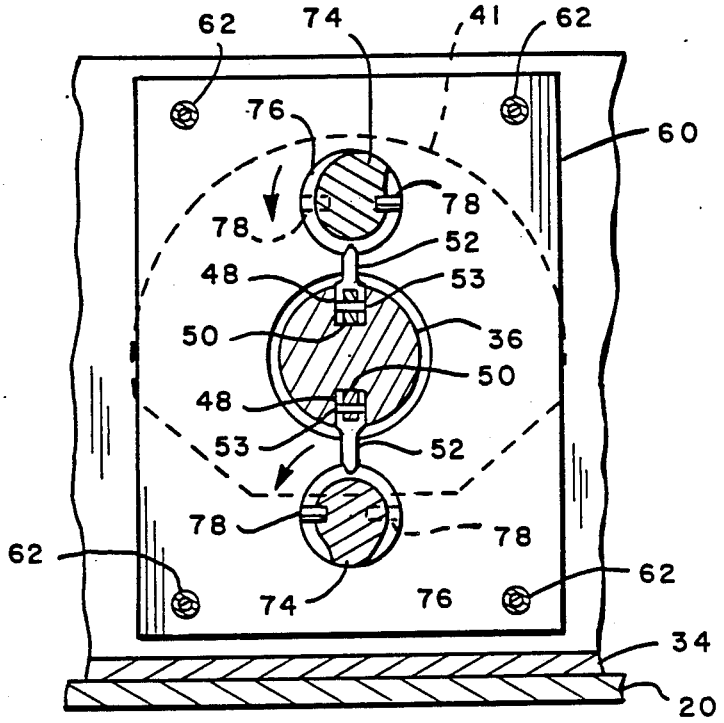
FIG. 3 shows a cross sectional view of the postage meter taken along the lines 3—3 of FIG. 2.

The postage meter 10 has a housing 34, only a portion of which is shown in FIG. 2, that rotatably supports a shaft 36 therein. It will be appreciated that in the following description of the postage meter, a large number of components that are generally part of a postage meter are not included and will not be discussed since they do not form, nor are a necessary part of, the instant invention. Only those elements that are required for the printing of postage will be described, and those elements associated with recording the amount of postage printed, storing the mount of postage available, security, and functions not associated with the actual printing of postage indicia will be included in this description only to the extent necessary.

A meter drive gear 38 is mounted on the shaft 36 and meshes with the gear 28 of the mailing machine 12 so as to be driven thereby. A portion of the shaft 36 extends through the meter housing 34 and supported thereon is a rotary drum 41. This rotary drum 41 rotatably supports a plurality of value print elements in the form of print wheels 42 upon a shaft 43. These print wheels 42 are received within an opening 44 of the rotary drum 41 and extend beyond the perimeter of the drum 41.

Figure 5:
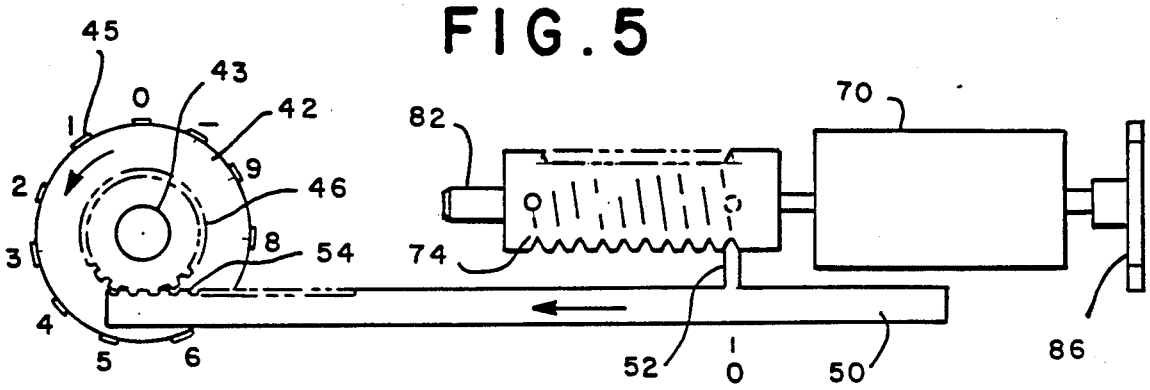
FIG. 5 is a cross sectional view taken along the lines 5—5 in FIG. 2.

The print wheels 42 have a plurality of fonts 45 forming numerical characters disposed about the perimeter thereof, the characters representing the denominations of 0–9 (see FIG. 5). Although a postage meter will generally have from 3 to 5 print wheels, the instant invention will be described for purposes of clarity with a rotary drum 41 having only two print wheels 42. It will be appreciated, however, that the principles of the invention can be applied to a postage meter having a larger number of print wheels. Each of the print wheels 42 has a coaxial gear 46 integral therewith or attached thereto. The shaft 36 has a pair of longitudinally extending slots 48 located 180° from one another. Each of these slots 48 receives a rack 50, each of the racks having a follower 52 secured thereto by a pin 53 and a plurality of teeth 54 at their distal ends which mesh with the teeth of the print wheel gears 46. In this way, as the rack 50 is moved longitudinally, the print wheels 42 will be rotated about the shaft 43.

Disposed within the housing 34 is a cage generally shown at 56 having opposed walls 58 and 60, one wall 60 being secured to the housing 34, for example, by a weld. A plurality of spacers 62 extend from one wall 60 to the other 58 to provide support for the wall 58. A plate 64 having upper and lower openings 66 and a larger central opening 68 is also supported by the spacers 62. A pair of DC motors 70 are secured to the plate 64 and each has opposed output shafts 72,73 that extend outwardly from opposite ends of the motor. A worm gear 74 having a helical thread 76 therein is attached to one of the output shafts 72. The worm gear 74 has a pair of pins 78 on opposite sides of the helical thread 76. Received within the thread 76 is a follower 52 of one of the racks 50. The pins 78 act as stops for the follower 52 thereby limiting the longitudinal direction of travel of its respective rack 50. More specifically, as the worm screw 74 is rotated, the follower 52 will be moved longitudinally by the helical thread 76 until it comes into contact with one of the pins 78. On the end opposite of the stepper motor 70, the worm gear 74 has a shaft 80 that is received within an opening 82 of the side wall 60 thereby providing support for the worm gear.

The portion of each motor output shaft 73 that extends from the side of the DC motor 70 opposite the worm gear 74 has a somewhat truncated encoding disk 86. The encoding disk 86 has a large diameter portion 88 extending 180° about its perimeter, and a small diameter portion 90 that extends the other 180° thereabout (see FIG. 4). The large diameter portion 88 of the disk 86 is receivable within a sensor 92,93. The sensors 92,93 have a light 96 and a photodetector 98 with a lead 94 extending therefrom thereby allowing the sensors 92,93 to determine the presence of the large diameter portion 88 of the disk 86.

Figure 8:
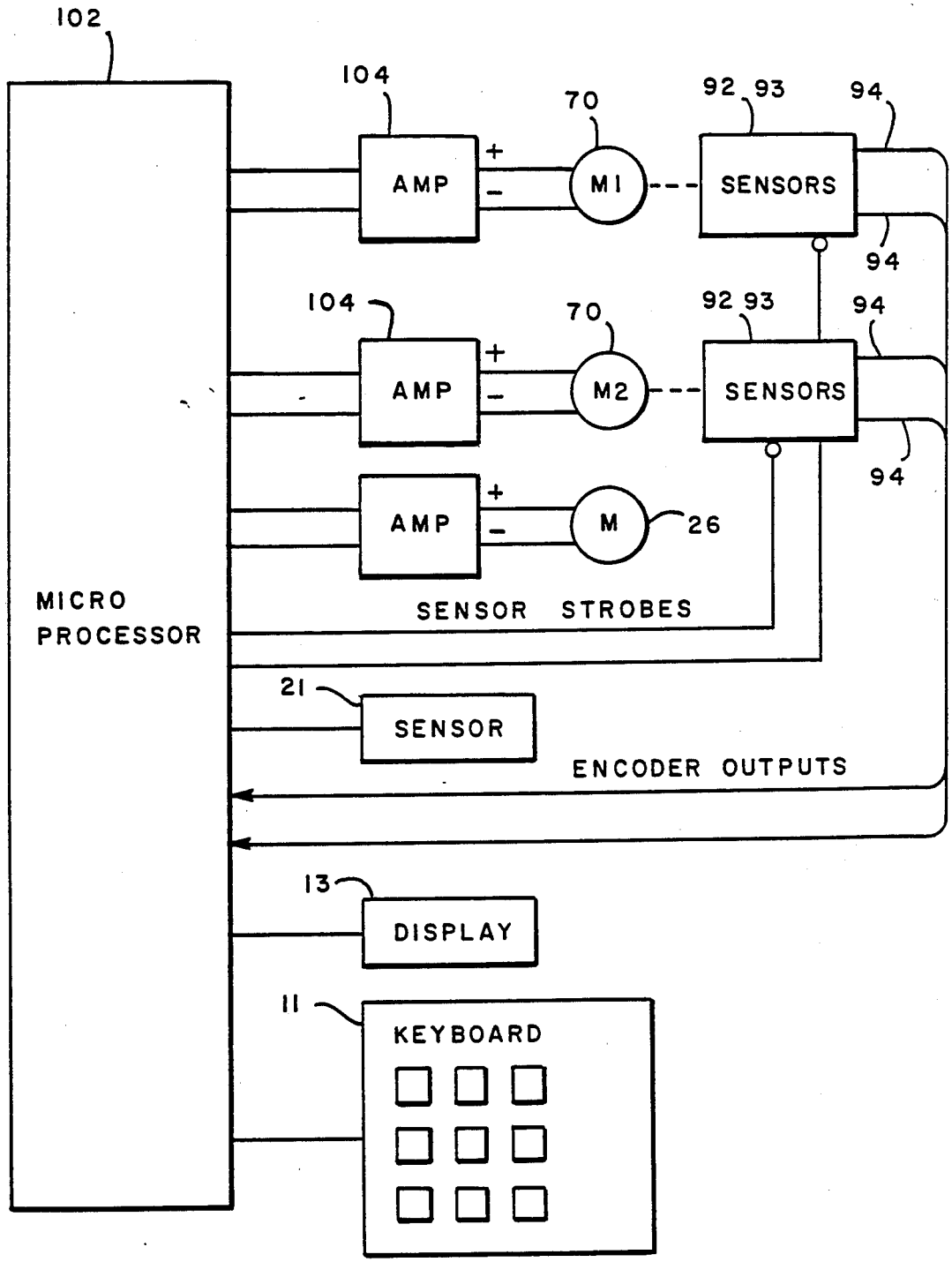
FIG. 8 is a graph showing the correlation between the location sensors and the rotation of the worm gear.

Referring now to FIG. 8, a block diagram of the circuitry is shown for the drive of the motors 26,70 and sensing of the disks 86. The postage meter supports a microprocessor 102 therein such as an Intel 8086 microprocessor. As is known, the microprocessor of a postage meter performs two basic functions: performance of calculations based on input data for the printing of postage and controlling of the flow of data between various memory units. For the purpose of the description of the instant invention, only the necessary portion of the function of performance of data calculation will be considered. The microprocessor 102 receives postage data input from the keyboard 11 indicating the amount of postage to be printed. The microprocessor 102 will send a signal through an amplifier 104 to each motor 70 to cause sufficient drive to rotate the print wheels 42 the required amount. The sensors 92,93 will determine the amount of rotation of each print wheel 42 and send print wheel location signals through the line connection 94 to the microprocessor 102 through a line decoder driver 108 that properly sequences the incoming signals for transmission to the microprocessor. In this way determination of the amount of postage set can be made. This amount will be shown on the display 13. Upon an envelope 22 being conveyed by the rollers 16,18 along the platform 20 and being sensed by the sensor 21, the microprocessor 102 will cause the motor 26 to be enabled to thereby print the postage by rotation of the print drum 41. The postage printed will then be accounted for by the microprocessor 102 in response to the determined setting of the print wheels 42.

The setting of the print wheels 42 will now be described in greater detail. Upon an amount of postage being input through the keyboard 11 to the microprocessor 102, the DC motors 70 will be enabled so that the worm gears 74 are rotated a sufficient amount until the followers 52 reach their maximum position, to the left as shown in FIG. 2, and then the DC motor will be rotated in the opposite direction so that the followers 52 will reach their starting points, i.e. each follower will engage the stop 78 on the right as seen in FIG. 2. In such a position, the zero font will be located in a printing position, i.e. extending through the opening 44 of the drum 41, for each of the print wheels 42. In this way the exact position of the print wheels 42 is known immediately prior to the setting of the amount on the print wheels.

After the worm gears 74 are zero positioned as described above, the DC motors 70 will rotate each worm gear 74 in accordance with the postage amount input through the keyboard 11 so as to drive its associated rack 50 an appropriate distance in accordance with this input postage amount. Each rotation of the DC motor, and obviously of the worm gear 74, will result in the print wheel 42 being rotated one unit or font. More specifically, as the worm gear 74 is rotated 360° the print wheel 42 will rotate a sufficient amount to rotate the zero digit out of the opening 44 and expose the "1" digit. With another 360° rotation the "2" digit will be exposed, and so on until the 9th digit is exposed upon nine complete revolutions of the worm gear 74. Rotation of each print wheel 42 is accomplished through the rotation of a worm gear 74 under drive by its associated DC motor 70, and the follower 52 moving longitudinally by action of the helical thread 76, thereby carrying the rack 50 therewith. The teeth 54 of the racks 50 are in engagement with the teeth 46 of the print wheels 42 and cause the print wheels 42 to rotate as the racks move linearly. After the print wheels 42 are set, the operator will supply an envelope 22 or envelopes to the rollers 16 so that such envelope is driven between the roller 18 and print drum 41. Upon this occurring, the sensor 21 will sense the leading edge of the envelope 22 and send a signal to a microprocessor 102 which will bring about rotation of the shaft 36 and drum 41 by enabling the motor 26.

Figure 4:
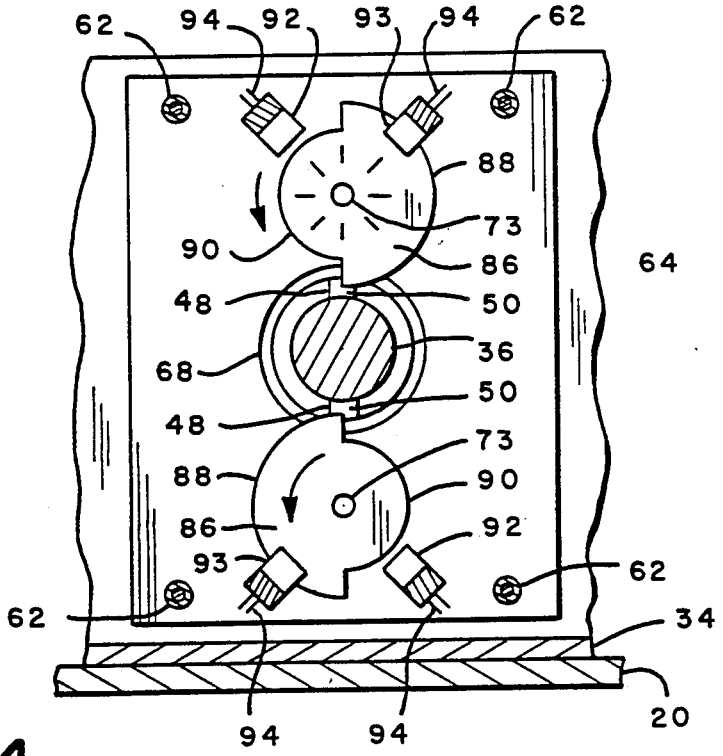
FIG. 4 shows a cross sectional view of the postage meter of FIG. 1 taken along the lines 4—4 of FIG. 2.
Figure 7:
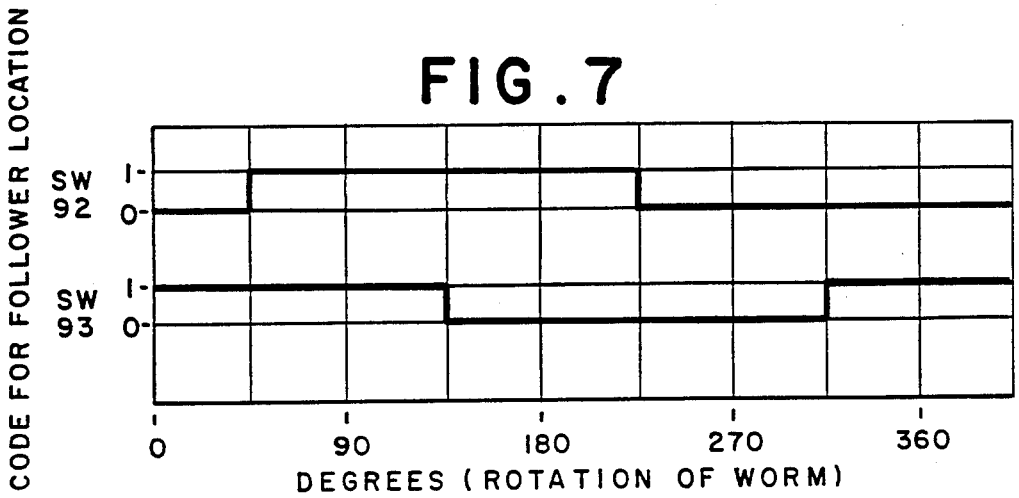
FIG. 7 shows a portion of the print wheel drive of the postage meter shown in FIG. 2 in greater detail.

During the time the motor shaft 72 rotates to set the print wheels, the encoding disks 86 will be driven by the shafts 72 and the large diameter portions 88 of the encoding disks will move in and out of the sensors 92,93. By having two diameters 88,90, and two sensors 92,93 that are 90° apart relative to the axis of the disk 86, one is able to determine the posture of the worm gear 74 relative to its angular position within a 360° revolution. With reference to FIGS. 4 and 7, when the worm gear 74 is at its home position, sensor 92 will not sense the disk 86, but sensor 93 will. This yields a binary code. For example, no detection will represent the binary bit "0" and detection would represent the binary bit "1". Consequently, in the rest or home position, the sensors 92,93 will yield a binary number 01. As the worm gear 74 rotates 90°, both sensors 92,93 will sense the presence of the encoding disk 86. This will yield the binary number 11. As the encoding disk rotates another 90° the first sensor 92 will sense the encoding disk 88, but the second sensor 93 will not, thereby yielding the binary number 10. Obviously, after a rotation of 270°, the encoding disk will not be sensed by either of the two sensors 92,93 to yield the binary number 00 and then, finally, with a complete rotation of 360° , the encoding disk 93 will sense the encoding disk, but not the sensor 92 to again yield the binary number 01. Obviously, when the binary number 01 is generated, it is known that a font 45 is in the printing position. Digital signals are sent from the sensors 92,93 to the microprocessor 102 to indicate th rotational posture of the worm gear 74. In this way, the angular position of each worm gear 74 can be determined and the number of rotations counted allowing the amount of postage that is to be printed is determined by the microprocessor 102.

The pitch of the helical thread 76 of each worm gear 74 is not constant, but varies within each 360° turn of the worm screw so as to control the movement of its follower 52. This maybe illustrated with reference to FIG. 6. With the first 90° of rotation, the follower 52 is not moved a large distance. During the next quarter of a turn of rotation, between 90 and 180°, the follower is moved more than during the first quarter of rotation. During the third quarter of rotation, between 180° and 270°, the movement duplicates the movement of the second quarter, and during the last quarter of rotation, between 270° and 360°, the amount of movement of the follower 52 duplicates that of the first quarter. The amount of movement of the follower 52 is indicated by the following table:

| WORM GEAR ROTATION DEGREES | RACK ADVANCE INCHES |
|---|---|
| 0°-45° | .0084 |
| 45°-90° | .0116 |
| 90°-135° | .0164 |
| 135°-180° | .0197 |
| 180°-225° | .0197 |
| 225°-270° | .0164 |
| 270°-315° | .0116 |
| 315°-0° | .0084 |
| TOTAL 360° | .1122 inches |

Figure 6:
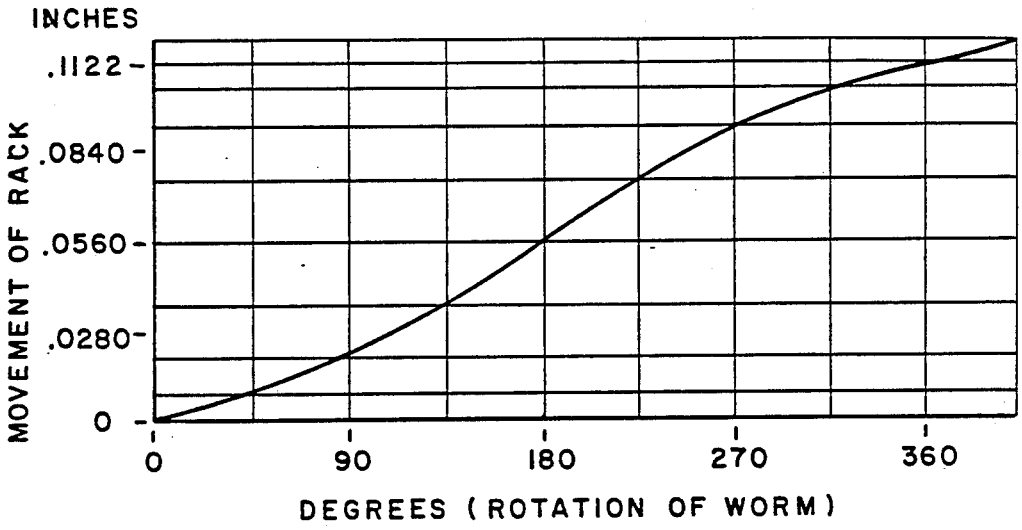
FIG. 6 is a perspective view of the sleeve.

With reference to the above table and FIG. 6, the rack 50 moves a small distance, 0.02", during the first quarter of revolution of the worm gear 74, a greater distance during the second and third quarters, 0.0361 each, and again a small distance, 0.02", during the fourth quarter. The reason for the smaller distances of movement by the racks 50 in the first and fourth quarters of worm gear 74 rotation is because the DC motor does not stop instantaneously after a complete setting, or, more precisely, when the motor is turned off. Consequently, a slight overrun will result or, alternatively, there could be a backlash. Because of the small amount of movement of the racks 50 during the first and fourth quarters, with such an overrun, or backlash, the fonts 45 that are exposed will not be moved so greatly that they cannot be printed accurately or postage accounted for. Additionally, by having a slight amount of motion in the first and last quarters turns of worm gear rotation, it has been found that noise is reduced. Preferably, the follower 52 will be moved 0 to 20% of the total distance to be travelled during each of the first and last quarters of rotation of the worm gear 74 and 30% to 50% each during each of the middle two quarters of rotation. It will be appreciated that the ordinate of the graph shown in FIG. 6 not only shows the movement of the pin 52, but also profiles the cam surface of the worm gear helical thread.

Consequently, what has been shown and described is a postage meter print wheel setting mechanism that greatly simplifies print wheel setting for the amount of postage to be printed. The tolerance built up and number of components are significantly reduced and the helix of the worm gear 74 assures accurate positioning of the racks 50 with a reduced amount of noise.

What is claimed is:

1. A postage meter for printing selected value amounts on a mail piece, comprising:

a support, a plurality of value print devices individually rotatably mounted by said support, each of said devices having a plurality of value printing elements on the perimeter thereof, a plurality of worm gears rotatably supported by said support means, a plurality of means for connecting said worm gears with said value print devices to rotate said value print devices individually upon rotation of each of said worm gears, each of said connecting means having a follower received within the helix of one of said worm gears, means for rotatably driving said worm gears, each of said worm gears having a helix with a varied pitch causing a follower received within said helix to move 0 to 20% its distance of travel during the first and last 90 degrees of rotation of said worm gear and travel 30 to 50% of its distance of travel during the middle two 90 degrees of rotation of said worm gear, and means for supporting a mail piece with said value print devices whereby a portion of said value printing elements will be in engagement with the mail piece.

2. The postage meter of claim 1 including means for determining the amount of rotation of said worm gears.

3. The postage meter of claim 1 wherein said worm gear has a pair of pins located within the helix thereof, said follower being received within the thread of said helix intermediate said pins.

4. The postage meter of claim 1 wherein said means for rotating each of said worm gears is a d.c. motor connected to each worm gear.

5. A postage meter comprising:

a housing, a rotatable shaft supported within said housing, a print drum having an opening therein and secured to one end of said shaft for rotation therewith, at least one print wheel rotatably supported within said print drum and having a portion extending through said print drum opening, said print wheel having a gear coaxially secured thereto, at least one rack slidably supported within said shaft and engageable with said gear whereby upon linear movement of said rack said print wheel is rotated, a follower secured to said rack, a worm gear having a helical thread rotatably supported within said housing, said follower being received within the thread of said worm gear, said helical thread having a varied pitch causing said follower to move 0 to 20% of its distance of travel during the first and last 90 degrees of rotation of said worm gear and travel to 30 to 50% of its distance of travel during the middle two 90 degrees of rotation of said worm gear and means for rotating said worm gear.

6. The postage meter of claim 5 including sensor means for determining the rotational position of said worm gear.

7. The postage number of claim 6 including means for determining the number of rotations said worm gear is driven by said rotating means.

8. The postage meter of claim 6 wherein said worm gear has a pair of pins located within the helix thereof, said follower being received within the thread of said helix intermediate said pins.

9. The postage meter of claim 5 wherein said means for rotating each of said worm gears is a d.c. motor.

10. The postage meter of claim 5 including means for rotating said print drum.

11. A postage meter for printing selected value amounts on a mail piece, comprising:

a support, a plurality of value print devices rotatably mounted by said support, each of said value print devices having a plurality of value printing elements on the perimeter thereof, a plurality of linearly displaceable racks each connected to a respective one of said value print devices for adjusting the same, a plurality of rotatable worm gears, each of said linearly displaceable racks having a follower received within the helix of a worm gear to cause said racks to move linearly and rotate said value print devices upon rotation of said worm gears, means for rotatably driving said worm gears, each of said worm gears having a helix with a varied pitch causing a follower received within said helix to move 0 to 20% its distance of travel during the first and last 90 degrees of rotation of said worm gear and travel 30 to 50% its distance of travel during the middle two 90 degrees of rotation of said worm gear and means for driving said value print devices whereby a portion of said value print elements will be driven into engagement with the mail piece.

12. The postage meter of claim 11 including means for determining the amount of rotation of said worm gears.

13. The postage meter of claim 11 wherein each of said worm gear has a pair of pins located within the helix thereof, said follower being received within the thread of said helix intermediate said pins.

14. The postage meter of claim 11 wherein said means for rotating each said worm gears is a d.c. motor.

* * * * *